US005662774A

United States Patent [19]

Ekholm et al.

[11] Patent Number: 5,662,774

[45] Date of Patent: Sep. 2, 1997

[54] ADJUSTING THE SULPHUR BALANCE OF A SULPHATE CELLULOSE PLANT BY HEAT TREATING BLACK LIQUOR IN A LAST EVAPORATION STAGE

[75] Inventors: Jari Ekholm; Esa Pikkujämsä, both of Tampere, Finland

[73] Assignee: Tampella Power Oy, Tampere, Finland

[21] Appl. No.: 399,987

[22] Filed: Mar. 6, 1995

Related U.S. Application Data

[63] Continuation-in-part of Ser. No. 40,448, Apr. 1, 1993, abandoned.

[30] Foreign Application Priority Data

Apr. 1, 1992 [FI] Finland ..... 921444

[51] Int. Cl.[6] ..... D21C 11/10

[52] U.S. Cl. ..... 162/16; 162/29; 159/2.1; 159/47.3; 203/88

[58] Field of Search ..... 162/16, 30.11, 162/29; 159/2.1, 22, 47.3; 203/88

[56] References Cited

U.S. PATENT DOCUMENTS

| | | | |
|---|---|---|---|
| Re. 24,293 | 3/1957 | Hagglund et al. | 260/609 |
| 4,929,307 | 5/1990 | Kiisica et al. | 159/47.3 |
| 5,112,441 | 5/1992 | Ruohola et al. | 159/47.3 |
| 5,201,172 | 4/1993 | Hakulin et al. | 60/39.05 |
| 5,230,773 | 7/1993 | Petanen | 159/47.3 |
| 5,234,546 | 8/1993 | Chamblee | 162/29 |
| 5,277,759 | 1/1994 | Sanholm | 162/16 |

FOREIGN PATENT DOCUMENTS

| | | |
|---|---|---|
| 2046545 | 1/1992 | Canada . |
| 73474 | 6/1987 | Finland . |
| 85515 | 1/1992 | Finland . |

OTHER PUBLICATIONS

Ryham, "High Solids Evaporation Through Thermal Depolymerization of Black Liquor", *Chem. Recovery*, pp. 157–160 (1989).

*Primary Examiner*—Donald E. Czaja
*Assistant Examiner*—Dean T. Nguyen
*Attorney, Agent, or Firm*—Banner & Witcoff, Ltd.

[57] ABSTRACT

The invention relates to a method of adjusting the sulphur balance of a sulphate cellulose plant, in which method black liquor is concentrated and heat treated by keeping it at a temperature higher than the cooking temperature for a certain time period to separate the sulphur compounds contained in the black liquor as gaseous sulphur compounds therefrom in the last evaporation stage of a series of evaporation stages.

8 Claims, 3 Drawing Sheets

FIG. 1
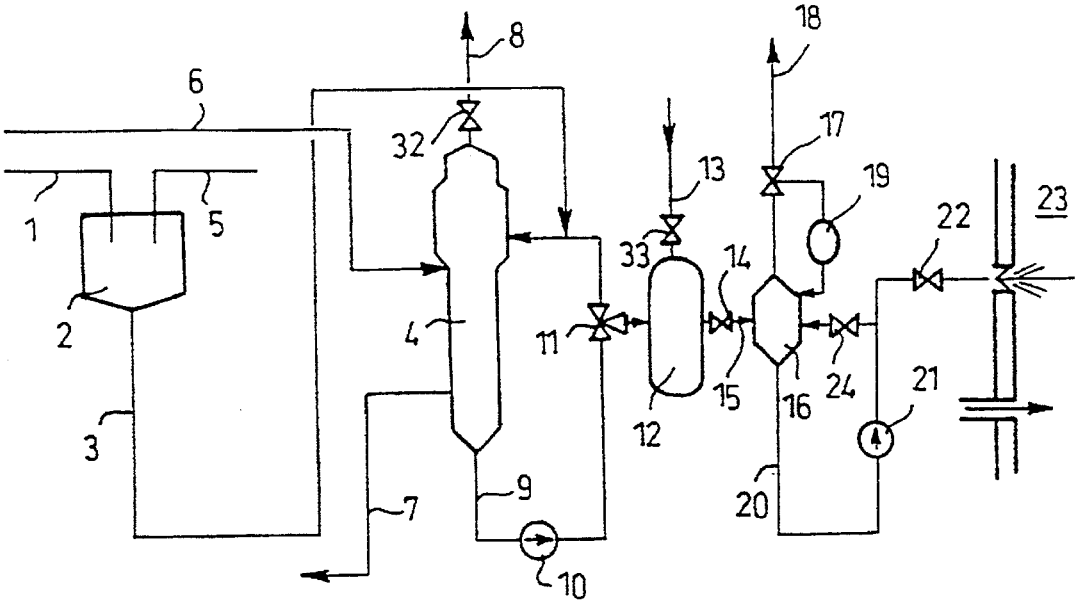
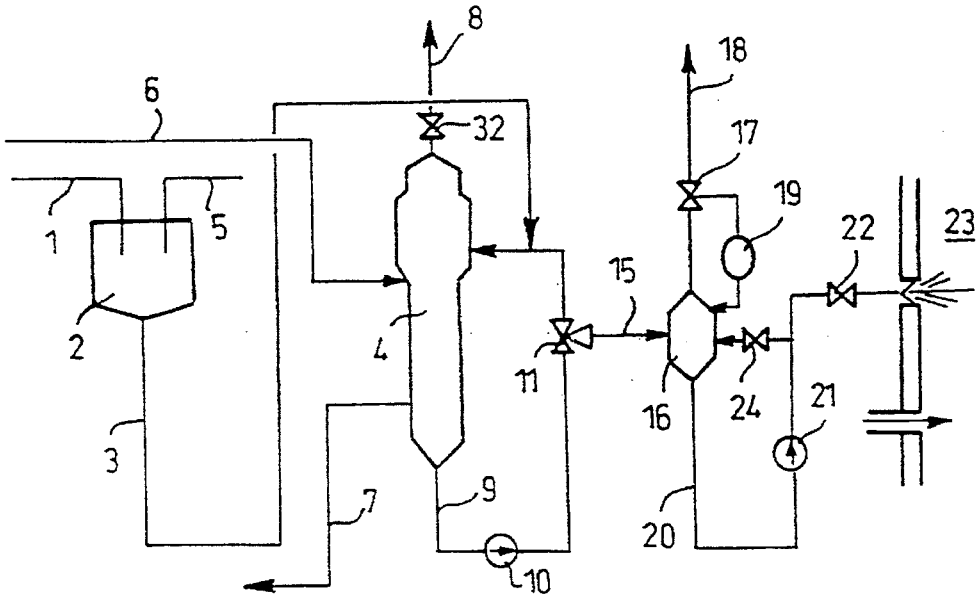
FIG. 2

ADJUSTING THE SULPHUR BALANCE OF A SULPHATE CELLULOSE PLANT BY HEAT TREATING BLACK LIQUOR IN A LAST EVAPORATION STAGE

This application is a continuation in part of application Ser. No. 08/040,448 filed Apr. 1, 1993, now abandoned, the disclosure of which is herein incorporated by reference.

FIELD OF THE INVENTION

The invention relates to a method for adjusting the sulphur balance of a sulphate cellulose plant. Sulphur values are removed as a gas from black liquor by heat treating the liquor at a temperature higher than cooking temperature and by adjusting the temperature and/or the delay time of the heat treatment.

BACKGROUND OF THE INVENTION

When manufacturing cellulose by sulphate cooking method, wood is cooked in an alkaline liquor containing sodium hydroxide and sodium sulphide. The lignin of the wood is separated from actual cellulose fibres. The cooking liquor and cellulose pulp are separated, and the pulp is then washed. The fibres from the pulp are then bleached and/or finished otherwise. The residual liquor, referred to as "black liquor", is further processed for recovery and reuse.

Black liquor contains many chemicals which can be recycled back to the cooking process following retreatment to reduce the amount of new chemicals required for the process. Black liquor also contains organic materials which can be burned for energy recovery provided that the liquor is sufficiently concentrated.

Black liquor is usually concentrated by utilizing the vapor produced at various stages of the process and the heat energy contained therein to evaporate water from the black liquor. The concentrated black liquor is then fed into a soda recovery boiler where it is burned and forms a smelt. Green liquor is prepared from the smelt from the soda recovery boiler and changed into white liquor, i.e. alkaline cooking liquor, by adding lime.

Sulphur enters a sulphate cellulose plant in the form of sulphuric acid from the manufacture of bleaching chemicals and for splitting tall oil in a tall oil cooking plant. This sulphur in a variety of resulting forms enters the pulp cooking process and must be addressed therein. Particularly troubling are the sulphurous gases generated during the process. Examples of sulphur gas discharge points include the cellulose cooking stage, the evaporation plant where black liquor is concentrated, and in the soda recovery boiler when black liquor is burned.

Excess sulphur poses a number of problems in a sulphate cooking process. Sulphur deposits foul equipment and reaction contact surfaces. Sulphur is also an odor nuisance and is considered to be a harmful emission to the environment. A reduction in sulphur gas emissions (e.g., by increasing the dry content of the liquor or by collecting all odor gases of the plant together to be destroyed by burning) causes an increase in sulphur in the liquor cycle. It would be desirable to have a process that would remove a desired amount of sulphur from the liquor cycle in order that the sulphur content of the cycle could be maintained as desired.

From the Finnish Published Specification 85515 (U.S. Pat. No. 5,277,759), for instance, sulphur is removed as a gas from black liquor by heating the black liquor before the last concentration stage to a temperature higher than the cooking temperature and maintaining that temperature for at least 20 minutes. Thereafter, the black liquor is permitted to expand and vapors containing gaseous sulphur compounds are released from the black liquor. The sulphurous gases are destroyed by combustion. The black liquor is further concentrated by further evaporation. Though obviously functional, the equipment required for the process is very large, is expensive, and has a very poor energy economy.

On the other hand, U.S. Pat. No. 2,711,430 teaches that gaseous sulphur compounds can be separated with water vapor from the black liquor by heating the black liquor to a temperature higher than the cooking temperature, maintaining that temperature for a sufficient time, and allowing the black liquor to expand. The amount of the sulphur separated is varied based on the temperature and especially on the delay time.

It would be desirable to have a process that would allow excess sulphur to be removed from the liquor cycle while preserving energy values where possible.

SUMMARY OF THE INVENTION

The object of the present invention is to provide a method wherein the sulphur levels in a cellulose plant can be adjusted as desired and as efficiently as possible.

The method according to the invention is characterized in that the heat treatment is performed in connection with or just after the last concentration stage of the black liquor. By this process, the black liquor can be concentrated to at least 80% solids while using the last concentration stage as the holding vessel for the heat treating process. By this process, the liquor concentration and heat treating steps can be performed in existing equipment or with very small changes to the process.

Specifically, a process according to the invention is directed to sulphate cellulose processes in which wood pulp is cooked in a liquor circulating within a liquor cycle of the process. The cooking process produces a pulp slurry and a residual black liquor which is concentrated to produce a concentrated black liquor having a solids content of about 70%. In the present invention, this concentrate is heated to a temperature of at least 140° C. (the specific temperature is selected to be higher than the cooking temperature) and further concentrated to a solids content of at least about 80% while aging the concentrate in a holding tank to allow sulphur values to form sulphurous compounds that can be separated as a gas with a drop in pressure. Thereafter, the pressure over the liquor is reduced to vaporize the formed sulphur compounds. These sulphur compounds are then removed from the process.

An advantage of the present invention is that the benefits can also be realized with the existing equipment and without significant additional investments while maintaining a high energy efficiency. At the same time, the sulphur level in the whole cellulose cooking process can be easily and simply adjusted. With suitable recovery and treatment, the sulphur values can be recycled as sulphuric acid for the bleaching process or to the tall oil splitting process thereby reducing the need for the purchase of sulphuric acid and increasing the economics of the process.

BRIEF DESCRIPTION OF THE DRAWINGS

FIG. 1 shows a system in which the method of the invention can preferably be realized.

FIG. 2 depicts a second embodiment of the equipment according to FIG. 1.

DETAILED DESCRIPTION

Figure 3:
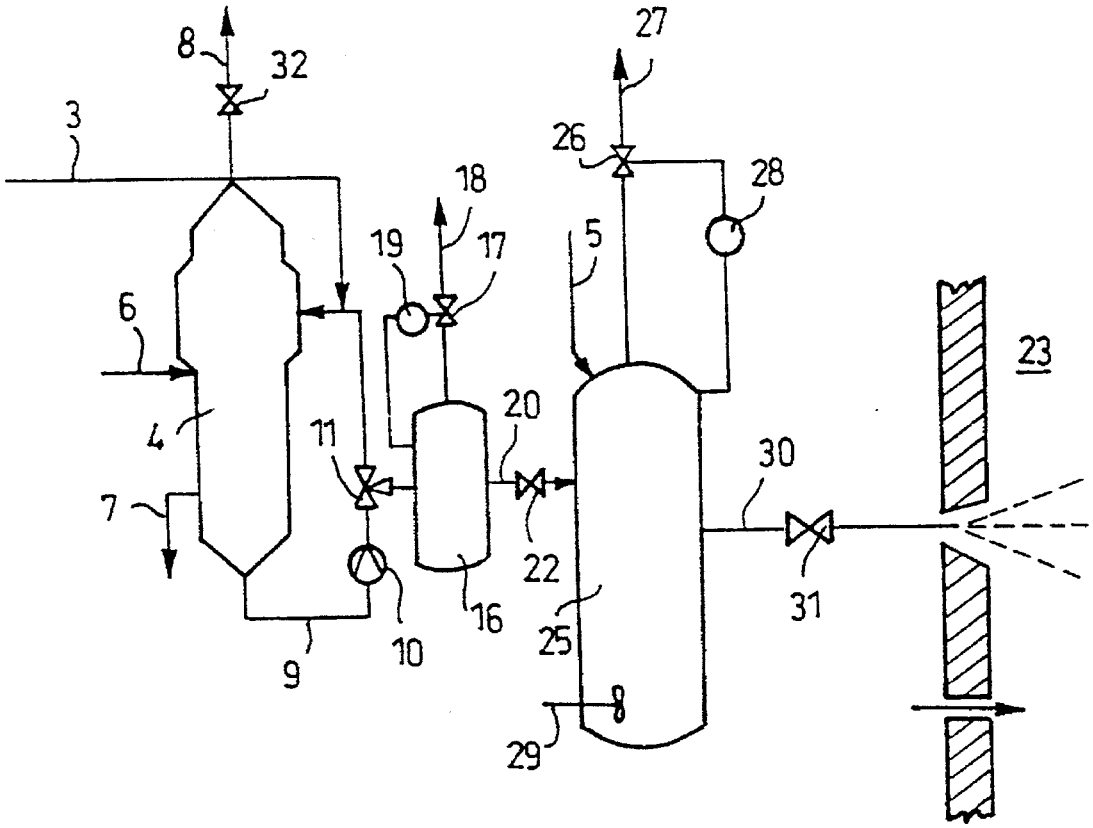
FIG. 3 shows schematically other equipment for realization of the second embodiment of the method of the invention.

In the solution of FIG. 1, concentrated black liquor of about 70% solids is fed through line 1 into mixing tank 2, from which it is fed further through line 3 into concentration reactor 4 which may be the last in a series of concentration reactors, preferably evaporators. Into the mixing tank 2 are also fed ash and possibly make-up chemicals through line 5. In the concentration reactor 4, liquor is concentrated either by direct or indirect heating from steam in line 6 to about 80% solids. Condensate is removed through line 7. Secondary steam separated from the liquor can be removed, if desired, from the upper part of the concentration reactor through line 8 by valve 32. Black liquor concentrate is removed from concentration reactor 4 with pump 10 and line 9. Part of the concentrated liquor is brought forward by means of a valve 11 into a holding tank 12, and a part is returned into the concentration reactor 4.

The black liquor in the concentration reactor 4 is heated to about 140° C., typically about 150°–170° C. with a corresponding pressure. In concentration reactor 4, the viscosity of the liquor decreases so that the liquor can be pumped forward despite a dry solids content of 80%. A delay time, e.g. 20 to 60 min. in the holding tank 12 is adjusted such that the sulphur begins to be separated from the liquor as gaseous compounds including, e.g., dimethyl sulphide.

From holding tank 12, the concentrated and aged black liquor is brought via line 14 through valve 15 into expansion tank 16. In expansion tank 16, the concentrated aged liquor is permitted to expand. Sulphurous gases and steam are separated and are led out of the upper part of the tank over a valve 17 into a 18. The discharge of gases and steam is adjusted in a simple manner by means of a pressure regulator 19, which controls the valve 17. From the expansion tank 16 the liquor is brought by means of a pump 21 through a line 20 over a valve 22 to be injected into a soda recovery boiler 23, in which it is burned in a known manner. A part of the liquor can be returned into the expansion tank 16 over a valve 24, if necessary.

As the pressure is reduced when heated concentrated liquor moves into expansion tank 16, the temperature of liquor in the holding tank falls a little with respect to the temperature of the concentration reactor. To counteract such a reduction in temperature, holding tank 12 can be heated by hot steam in line 13 through valve 33. Such steam can be taken from a suitable place of the cellulose process, e.g. from soot blowing steam of a soda recovery boiler. The concentrated black liquor temperature should be maintained at a temperature higher than the original cooking temperature of the pulp cooking stage (not shown). This will usually mean that is a corresponding pressure in the delay tank.

Steam removed from concentration reactor 4 through line 8 can be used at previous concentration and evaporation stages for heating the liquor. Steam containing sulphurous gases removed through line 18 can be used in a suitable manner by bringing it to a combustion plant or a catalyst plant to be retreated in order that the sulphur can be changed into a state as utilizable as possible, such as sulphuric acid.

The method according to FIG. 1 can also be realized without holding tank 12 in such a way that the holding time of the liquor in the concentration reactor 4 is lengthened to 20–60 minutes, in which time the sulphur compounds are separated from the liquor. A separate holding tank 12 is then not needed, but the liquor is brought directly into the expansion tank 16 in which the sulphur compounds are released and can be removed as gaseous compounds. This embodiment is shown in FIG. 2, which corresponds to FIG. 1 as far as the reference numerals are concerned, except for that holding tank 12 with associated parts is missing, because the liquor is fed after the delay in the concentration reactor 4 directly into the expansion tank 16 through line 15. The consequence is then that the size of the concentration reactor 4 increases to some degree which is not significant.

FIG. 3 shows a system suitable for realizing a second embodiment of the method of the invention. (The reference numerals used correspond to those of respective parts of the equipment according to FIG. 1.) In FIG. 3, the concentrated liquor is brought directly through line 3 into concentration reactor 4.

In the system shown in FIG. 3, the method of the invention can be effected by using a two-stage expansion in such a way that the liquor is heated in the concentration reactor 4 to a sufficiently high temperature, e.g., about 190° C., in which case the pressure in the reactor naturally corresponds to the temperature. When the dry solids content of the liquor is suitable, at least about 80%, the liquor is led into an expansion tank 16 where the liquor temperature falls with simultaneously falling pressure.

The concentrated liquor stays in the expansion tank 16 for a suitable time, i.e. 20 to 60 minutes, to age and allow the sulphur to separate from the liquor as gaseous compounds. Part of the gaseous sulphur compounds can be removed together with steam as gaseous compounds 18. The remainder passes together with the aged and concentrated liquor into an ash mixing tank 25 wherein the aged concentrated liquor is allowed to expand further to a lower pressure. In connection with the expansion, the main part of the sulphurous gases is separated from the liquor with the steam and removed over a valve 26 into a line 27. The expansion can naturally be carried out in more than two stages, in which case expansion tanks are added.

The pressure control in the ash mixing tank 25 occurs by means of a regulator 28, which controls the valve 26. In the ash mixing tank, the liquor is mixed with ash and/or make-up chemicals coming through a line 5. Mixing is performed as efficiently as possible by means of a mixer 29 in the lower part of the tank. From the ash mixing tank 25, the aged and concentrated liquor that has been freed of gaseous sulphur compounds is passed through a line 30 over a valve 31 to soda recovery boiler 23 for conventional burning.

Figure 4:
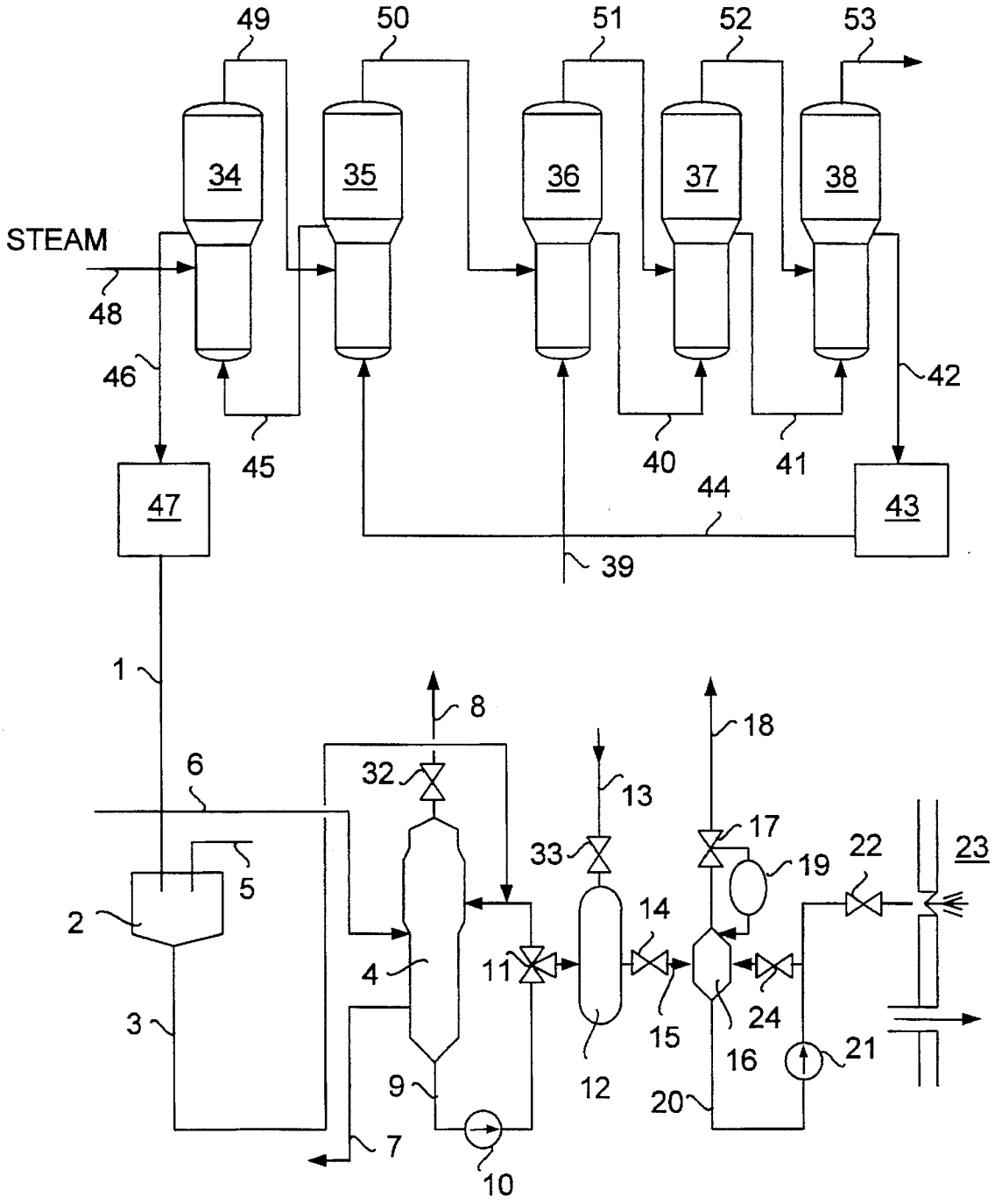
FIG. 4 illustrates a series of steps in a sulphate cellulose process of the present invention.

FIG. 4 is a schematic view of a conventional evaporating plant at a sulphate cellulose plant following integration with the system shown in FIG. 1. Such a plant would be upstream of the systems depicted in FIGS. 1–3. The evaporating plant is made of a series of evaporators 34–38 where the black liquor is heated indirectly with steam to increase the dry solids content of the black liquor and remove water. Five evaporators are depicted in FIG. 4, but more or less than five evaporators can be used.

Dilute black liquor 39 with a dry solids content within the range from about 15–18% is fed to evaporator 36. A relatively more concentrated black liquor 40 is removed and passed to evaporator 37 for additional concentration. Concentrated black liquor 41 is further concentrated in evaporator 38. Concentrated black liquor 42 has a solids content within the range from about 25–30% and is passed to intermediate liquor tank 43. Thereafter, stored liquor 44 is passed to evaporator 35 and evaporator 34. Concentrated black liquor 46 having a solids content of about 70% is passed to tank 47 and forms concentrated black liquor feed 1 described in FIGS. 1–3.

Final evaporator 4 is operated to further concentrate the black liquor from 70% solids to 80% solids. See, U.S. Pat. No. 5,112,441 the disclosure of which is herein incorporated by reference.

Steam is used to concentrate the black liquor in a countercurrent exchange pattern by feeding fresh, hot steam 48 into evaporator 34. The contact will form steam 49 that is reduced both in temperature and pressure relative to steam 48. Steam 49 is then passed to evaporator 35 to make steam 50. This pattern continues to make streams 51–53 containing steam from each subsequent evaporator 36–38. Through each evaporator, the pressure and temperature of the steam stream is reduced while water is evaporated from the black liquor.

As described with reference to FIGS. 1–4, the temperature of the concentrated black liquor in evaporator 4 is raised to a temperature higher than that of the pulp cooking stage (not shown) which also permits evaporation to be performed to a solids content of at least about 80-%, preferably higher than 80%. Once at temperature, the 80% concentrated liquor is held and aged for a period of about 20–60 minutes (either within evaporator 4 or in holding tank 12) before being allowed to expand in expansion tank 16 and separate gaseous compounds 18 including sulphur compounds.

By the present process, the desired amount of sulphur can be removed from the liquor by controlling the treatment temperature and time as well as the amount of incoming sulphur that is allowed to accumulate in the process liquor. If less sulphur is desired, a greater amount of sulphur is removed after the last concentration stage (e.g., by increasing the holding time at temperature in tank 12) relative to the amount of new sulphur that may be introduced into the process. Sulphur levels can be increased by reducing the holding time and removing less sulphur. By a combination of these mechanisms, the desired sulphur balance can be achieved in the process liquor circulating through a sulphate cellulose plant.

The invention can be applied especially well to the process described in Finnish Patent 73474 (U.S. Pat. No. 5,112,441) in which the final liquor concentration step occurs under a pressure higher than atmospheric pressure and at a temperature higher than the boiling point of the atmospheric pressure of the liquor. As modified by the present invention, sulphur would be separated from the concentrated liquor merely by adding a holding tank between the last evaporator and the expansion tank. The liquor in the holding tank would be heated, e.g., by hot steam, if needed. The realization of the method as an investment is thus rather cheap and easily applicable.

The invention can also be applied to the solution of the Finnish Application Ser. No. 894049 (U.S. Pat. No. 5,230,773), in which is described a process for obtaining a high dry solids content. In that process, ash is not fed to the black liquor until a separate ash mixing tank positioned between the system of a last evaporator and an expansion tank, and the boiler. With the present process, sulphur removal can be performed by adding a holding tank before the expansion tank. Alternatively, the expansion tank after the last concentration stage can be used for the heat treatment as well as the holding tank with separation of the sulphurous gases in the last ash mixing tank wherein the black liquor is also expanded.

In the specification and drawings above, the invention has been described by way of example only and it is by no means restricted to it. The suitable heat treatment temperature and delay time depend on the equipment to be used and on the sulphur separating capacity needed, but the most substantial thing is that an already existing concentration reactor equipment with its expansion tanks can be used almost as such for the heat treatment of liquor by using the method of the invention and no extra heating and/or delay tanks and expansion tanks have to be built separately.

We claim:

1. In a sulphate cellulose pulping process in which wood is cooked in a cooking liquor at a cooking temperature to produce a cellulose pulp slurry and a residual black liquor, and water is evaporated from said black liquor in a series of evaporation stages to produce concentrated black liquor, said concentrated black liquor is burned to form a smelt which is converted into said cooking liquor, the improvement comprising a method for adjusting the amount of sulfur removed from black liquor by the steps comprising:

(a) further evaporating water from said concentrated black liquor in the last evaporation stage to form a concentrated black liquor having a dry solids content of at least 80% while heating the thus formed concentrated black liquor to a temperature that is greater than said cooking temperature and holding at said heated temperature for a time sufficient to separate the sulfur compounds contained in the heated concentrated liquor by forming separable gaseous sulfur compounds;

(b) reducing the pressure of said heat treated concentrated black liquor immediately after said last evaporation stage to allow said separable sulfurous compounds to separate as a gas from said concentrated liquor; and (c) removing the sulfur as said separated gaseous sulfur compounds in an amount sufficient to adjust the sulfur content of said cooking liquor.

2. A method according to claim 1, wherein the evaporating step comprises: heating the concentrated liquor to a temperature of at least 150° C.

3. A method according to claim 1, wherein the evaporating step further comprises: heating said concentrated liquor for a time within the range from 20 to 60 minutes.

4. A method according to claim 1, further comprising:

reducing the pressure over the heat treated, concentrated black liquor and allowing said liquor to cool to an intermediate temperature that is lower than the concentration temperature but higher than said cooking temperature;

maintaining said black liquor at said intermediate temperature for a time period;

and further reducing the pressure over said black liquor to separate sulfurous gases from said black liquor.

5. A method of adjusting the sulphur balance of a sulphate cellulose process by removing sulfur from the liquor cycle of a sulphate cellulose pulping process in which wood is cooked in a cooking liquor at a cooking temperature to produce a cellulose pulp slurry and a residual black liquor, water is evaporated from said black liquor in a series of evaporation stages to produce concentrated black liquor, said concentrated black liquor is burned to form a smelt which is converted into said cooking liquor, said method comprising the steps of:

(a) further evaporating water from said concentrated liquor in the last stage to form a concentrated black liquor having a dry solids content of at least 80% while heating the thus formed concentrated black liquor to a temperature greater than said cooking temperature;

(b) keeping said heated black liquor after said last evaporation stage in a holding stage at said heated temperature and for a time sufficient to to separate the sulfur compounds contained in the heated concentrated liquor by forming separable gaseous sulfur compounds;

(c) reducing the pressure over said concentrated liquor to allow the gaseous sulfur compounds to separate from said concentrated liquor; and (d) removing said gaseous sulfur compounds in an amount sufficient to adjust the sulfur content of said cooking liquor and further recovering said gaseous sulfur compounds.

6. A method according to claim 5, wherein the heating step comprises: heating said concentrated black liquor to a temperature of at least 150° C.

7. A method according to claim 5, wherein the heating step comprises: heating said concentrated black liquor for a time of 20 to 60 minutes.

8. A method according to claim 5, further comprising:

reducing the pressure over the heat treated, concentrated black liquor and allowing said liquor to cool to an intermediate temperature that is lower than the concentration temperature but higher than said cooking temperature;

maintaining said black liquor at said intermediate temperature for a time period;

and further reducing the pressure over said black liquor to separate sulfurous gases from said black liquor.

* * * * *